US005332452A

United States Patent [19]

Das

[11] Patent Number: 5,332,452

[45] Date of Patent: Jul. 26, 1994

[54] COATING COMPOSITION AND METHOD FOR THE TREATMENT OF FORMED METAL SURFACES

[75] Inventor: Narayan Das, Libertyville, Ill.

[73] Assignee: Coral International, Inc., Waukegan, Ill.

[21] Appl. No.: 889,785

[22] Filed: May 28, 1992

Related U.S. Application Data

[62] Division of Ser. No. 653,715, Feb. 11, 1991, Pat. No. 5,139,586.

[51] Int. Cl.[5] ..... C23C 22/34

[52] U.S. Cl. ..... 148/247

[58] Field of Search ..... 148/247

[56] References Cited

U.S. PATENT DOCUMENTS

| | | | |
|---|---|---|---|
| 3,945,930 | 3/1976 | Sugiyama et al. | 252/32.5 |
| 3,969,135 | 7/1976 | King et al. | 134/41 |
| 4,384,965 | 5/1983 | Hellsten et al. | 252/32.5 |
| 4,637,885 | 1/1987 | Kuwamoto et al. | 252/32.5 |
| 4,758,359 | 7/1988 | Kirk et al. | 252/32.5 |
| 4,944,889 | 7/1990 | Awad | 252/32.5 |
| 5,030,323 | 7/1991 | Awad | 252/32.5 |
| 5,080,814 | 1/1992 | Awad | 252/49.3 |

*Primary Examiner*—Sam Silverberg

*Attorney, Agent, or Firm*—Fitch, Even, Tabin & Flannery

[57] ABSTRACT

An aqueous, acidic composition for application to aluminum and aluminum alloy surfaces comprising a source of zirconium ions, a source of fluoride ions, a source of phosphate ions, a phosphate acid ester, a polyethylene glycol ester of a fatty acid, and nitric acid, and a method for treating aluminum and aluminum alloy surfaces with such a composition.

27 Claims, 6 Drawing Sheets

COATING COMPOSITION AND METHOD FOR THE TREATMENT OF FORMED METAL SURFACES

This is a division of application Ser. No. 07/653,715, filed Feb. 11, 1991, now U.S. Pat. No. 5,139,586.

INTRODUCTION

1. Technical Field

This invention relates to a chemical composition and method useful for improving certain properties of aluminum and aluminum alloy surfaces. More particularly, the invention relates to the chemical treatment and conversion coating of aluminum surfaces to provide corrosion resistance and adhesion for applied paints, inks, and lacquers. The chemical composition of the present invention also provides secondary cleaning of the treated surface during the conversion coating process. In addition, the surface treatment improves the mobility of formed metal surfaces, such as the conveyance of aluminum cans through single filer and printer facilities in a can production plant.

2. Background

Aluminum cans are commonly used as containers for a wide variety of products, notably food and beverages. After manufacture, aluminum cans are washed, typically with an acidic cleaner, to remove aluminum fines and other residues. The cans are then water-rinsed or otherwise appropriately treated to ensure satisfactory adhesion of desired overcoatings and finishes (such as decorative inks and overvarnishes). Typically, washed aluminum cans are provided with a conversion coating, which imparts corrosion resistance to the aluminum surface and prepares the surface for subsequent application of overcoatings and finishes.

The cleaning treatment employed for aluminum cans, however, usually leads to etching on the surface of the metal. When treatment conditions are optimized to remove all of the aluminum fines from the inside as well as the outside of the cans, the resulting increased roughness on the outside can surface usually leads to can mobility problems on conveyors, especially single filers and conveyors to printers.

Problems with printer misfeedings, frequent jammings, down time, and loss of production occur as a result of inadequate can mobility. Therefore, increased mobility is highly desirable to increase the rate of production, without necessitating the building of new facilities for can manufacture.

Increased mobility entails the modification of the surface properties of aluminum cans. A concern in the modification of surface properties is that such modification may adversely affect the adhesion properties of the cans and, consequently, the conversion coating, which provides corrosion resistance and allows for the application of desired inks and overvarnishes to the cans.

Therefore, a chemical composition and method for improving the surface properties of aluminum and aluminum alloys to allow for improved mobility, without adversely affecting adhesion properties, are highly desirable. It would be ideal if the use of such a chemical composition could be incorporated into the treatment stage, e.g., can washing, so changes to existing can manufacturing facilities would be either unnecessary or minimal.

The treatment should preferably provide the surface of the aluminum container, in particular the surface of aluminum beverage containers, with a clear, colorless protective coating that retains the brightness of the aluminum surface, yet will not affect the taste of the food or beverage to be contained therein. Even more preferably, the treatment should additionally provide the surface of the aluminum container with resistance to corrosion, which may result from contact with corrosive materials. The treatment, however, should not adversely affect the adhesion of subsequently applied overcoatings and varnishes.

These benefits are realized through use of the present inventive composition and method, which enhance the mobility of aluminum and aluminum alloy surfaces and which impart corrosion resistance to the treated surfaces, without adversely affecting the adhesion properties of the treated surfaces. Moreover, due to the chemical composition of the conversion coating and the incorporation of the method into the can treatment stage, i.e., can washing, the treatment additionally provides secondary cleaning.

3. Relevant Literature

The prior literature is replete with references to corrosion-inhibiting compositions which provide metal surfaces, such as aluminum, with conversion coatings.

U.S. Pat. No. 4,017,334 discloses a process of coating aluminum cans for resistance to corrosion and adherence to paint which involves contacting the surface of the cans with an aqueous solution of tannin, titanium, fluoride, and phosphate, preferably pH 3–4, for 5–30 seconds, prior to inking and lacquering.

U.S. Pat. No. 4,148,670 discloses an acidic, aqueous solution for coating aluminum surfaces to provide corrosion resistance and coating adhesion. The coating solution contains zirconium and/or titanium, fluoride, and phosphate. Additionally, the solution may contain a polyhydroxy compound of 6 or less carbon atoms. The coating solution is capable of forming a uniformly clear and colorless coating on an aluminum surface.

U.S. Pat. No. 4,338,140 discloses an aqueous, acidic composition for the improvement of corrosion resistance of a metal surface, e.g., aluminum. The composition contains hafnium and/or zirconium and fluoride. Preferably, a vegetable tannin compound is added and, optionally, phosphate ions.

U.S. Pat. No. 4,370,177 describes an acidic, aqueous coating solution which contains zirconium, hafnium or titanium, and fluoride. The solution is effective in forming a coating on an aluminum surface which provides corrosion resistance and adhesion for overcoating. The solution additionally contains a combination of surfactants said to improve stain resistance in hot water.

U.S. Pat. No. 4,470,853 discloses an aqueous, acidic composition for improved coating of aluminum. The composition comprises zirconium, fluoride, tannin, phosphate, and zinc. The pH of the coating solution is in the range of about 2.3 to about 2.95. The solution produces a conversion coating on the aluminum surface, which improves corrosion resistance and adhesion for decorative overcoating and finishes.

In distinct contrast to the present invention, none of the corrosion-inhibiting compositions disclosed in these references purport to improve the mobility of treated metal surfaces, such as the conveyance of aluminum cans through single filer and printer facilities in a can production plant, in addition to providing corrosion resistance and adhesion to subsequently applied paints, inks, and lacquers.

Various lubricants are disclosed in the prior literature which may, upon application to metal surfaces, improve the mobility of treated metal surfaces.

U.S. Pat. No. 2,285,835 discloses a lubricant which contains an aryl or aliphatic ester of phosphoric or phosphorous acid. The phosphoric/phosphorous acid ester, however, is only a minor component of a predominantly petroleum, mineral, or hydrocarbon lubricating oil composition, which is used as a high-pressure lubricant for metallic bearing surfaces.

U.S. Pat. No. 4,116,872 discloses a lubricant comprising at least one substantially neutral ester, prepared from polyalkylene glycol, saturated aliphatic alcohols of ten or more carbon atoms, $C_{12}$–$C_{25}$ aliphatic monocarboxylic acids, and $C_4$–$C_{20}$ aliphatic polycarboxylic acids. The lubricant additionally contains a phosphorous acid.

U.S. Pat. No. 4,612,128 discloses a lubricating composition comprising an oil, at least one phosphate ester of pentaerythritol, and at least one compound selected from phosphate monoesters and diesters and phosphonates.

U.S. Pat. No. 4,260,499 discloses a water-based lubricant comprising 0.005–4.0 wt. % of a $C_6$–$C_{18}$ alkylphosphonate or an amine adduct, 0.005–4.0 wt. % of an ethoxylated oleic acid, ethoxylated dimer acid, or a mixture of ethoxylated rosin fatty acids, 0.003–0.60 wt. % of an alkali or alkaline earth metal hydroxide and/or dye, and 95–99.5 wt. % water. The lubricant purportedly has anti-wear and extreme pressure properties, comparable to hydraulic mineral oils, and is used in metal-working processing.

U.S. Pat. No. 4,859,351 discloses a lubricant and surface conditioner for formed metal surfaces, particularly aluminum beverage containers. The conditioner reportedly reduces the coefficient of static friction of the metal surfaces and increases their mobility. The adhesion of paints or lacquers to the treated surfaces is purportedly unaffected. The conditioner is a water-soluble, organic material selected from the group of phosphate esters, alcohols, fatty acids, including mono-, di-, tri- and poly-acids, and fatty acid derivatives, such as salts, hydroxy acids, amides, esters, and ethers. Ethoxylated stearic acid and an ethoxylated alkyl alcohol phosphate ester at a pH between about 1.0 and about 6.5 are particularly specified. The conditioner is primarily used as a final rinse in an aluminum can washer to obtain a thin organic film on the aluminum can surface to enhance mobility.

These disclosed lubricants, in contrast to the composition of the present invention, do not purport to provide corrosion resistance in addition to mobility enhancement to the treated surfaces, without adversely affecting the adhesion of subsequently applied overcoatings, such as paints, inks, and lacquers. The combination of a lubricant, corrosion inhibitor, and conversion coating for adhesion to overcoating in a single composition, such as that provided by the present invention, has not been disclosed in the prior art, especially not a composition which can be applied in a single treatment that can be incorporated into the washing of formed metal surfaces.

BRIEF SUMMARY OF THE INVENTION

The present invention concerns a composition for application to formed metal surfaces, particularly aluminum and aluminum alloy surfaces, and a method of treating metal surfaces with such a composition.

An object of the present invention is to provide aluminum or aluminum alloy surfaces with corrosion resistance.

Another object of the present invention is to provide adhesion for overcoating of aluminum and aluminum alloy surfaces with paints, inks, and lacquers.

A further object of the present invention is to enhance the mobility characteristics of formed aluminum and aluminum alloy surfaces.

These and other objects and advantages of this invention, as well as additional inventive features, will become apparent from the description which follows.

A composition which provides a coating on formed metal surfaces and a method for providing such a coating have been developed which provide corrosion resistance, adhesion to overcoatings, and improved mobility to the treated metal surfaces. The coating is formed from the application of a composition comprising a source of zirconium ions, a source of fluoride ions, a source of phosphate ions, a phosphate acid ester, a polyethylene glycol ester of a fatty acid, and nitric acid. The composition may additionally contain a water conditioner.

The present inventive composition and method are preferably used in conjunction with the processing of drawn and ironed aluminum cans. Specifically, aluminum cans, which have been cleaned with-an acidic cleaner and rinsed with cold tap water, are sprayed with the composition during the subsequent deionized water rinse, preferably for about 10–60 seconds at about 30°–55° C. and at a pH of about 2.5–4.0, and are then oven dried, preferably at about 175° C. for about 3.5 minutes. By incorporating the treatment into the can washing procedure, secondary cleaning is additionally obtained with the composition of the present invention.

DESCRIPTION OF THE PREFERRED EMBODIMENT

Figure 1:
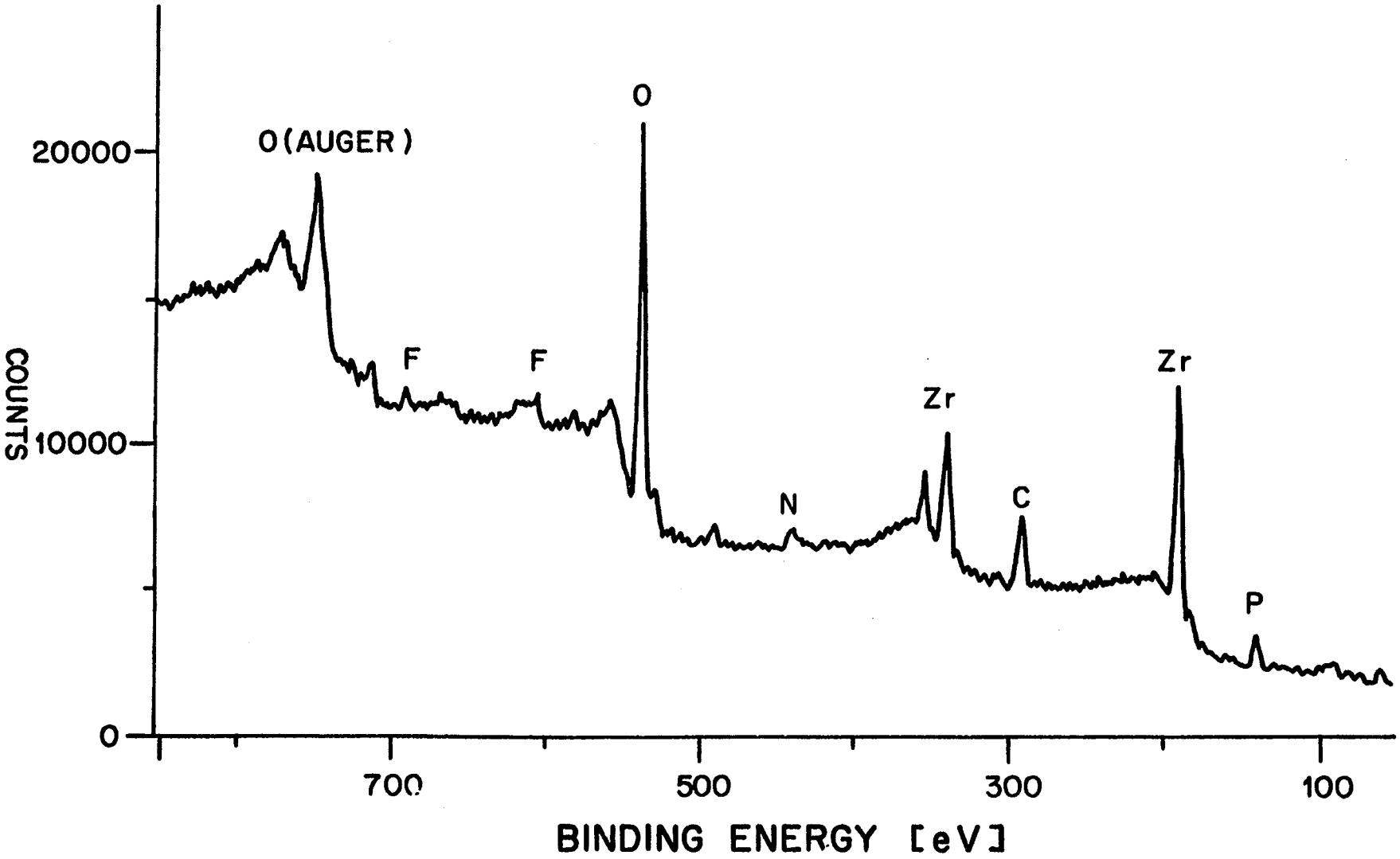
FIG. 1 depicts Electron Spectroscopy for Chemical Analysis (ESCA) results of the surface analysis of a cleaned aluminum surface treated with a composition similar to that of a preferred composition of the present invention but without a phosphate acid ester and a polyethylene glycol ester of fatty acid.

The present invention provides a composition and a method which provide a conversion coating for metal surfaces, particularly aluminum and its alloys. The present inventive composition and method may be used in a wide variety of applications and are particularly useful in the manufacture of aluminum cans, e.g., food and beverage cans, and building products and extrusions. The conversion coating on a metal surface treated in accordance with the present invention is clear and colorless and provides corrosion resistance, adhesion for overcoating, and improved mobility of the treated surface.

In accordance with the preferred embodiment of the present invention, the coating is formed by subjecting aluminum to a treatment bath of the present inventive composition at a pH between about 2.0 and about 5.0, preferably between about 2.5 and about 4.0, at a temperature between about 30° C. and about 55° C., preferably between about 35° C. and about 50° C., for a period of time ranging from about 10 seconds to about seconds. The composition of the treatment bath, from which the coating is produced, is a solution comprising sources of zirconium ions, fluoride ions and phosphate ions, a phosphate acid ester, a polyethylene glycol ester of fatty acid, and nitric acid. An "organic package" (phosphate acid ester and polyethylene glycol ester of fatty acid) to zirconium ion ratio of at least about 2, preferably at least about 5, and most preferably at least about 10, and "organic package" to phosphoric acid ratio of at least about 5, preferably at least about 10, based on a ratio of phosphate acid ester to polyethylene glycol ester of fatty acid of at least about 2 and preferably less than 5, is preferably maintained in the treatment composition in order to obtain an optimum conversion coating for corrosion resistance, adhesion for overcoating, and mobility enhancement. The composition may be applied to aluminum and aluminum alloy surfaces during the treatment cycle of washing formed metals.

The source of zirconium ions may be any suitable source, including, e.g., hydrofluozirconic acid, alkali metal and ammonium fluozirconates, or zirconium fluoride, nitrate, or carbonate. Hydrofluozirconic acid is preferred as the source of zirconium ions. The concentration of zirconium ions in the treatment bath may. range from about 10 ppm (0.010 g/l) to about 100 ppm (0.100 g/l), preferably from about 20 ppm (0.020 g/l) to about 60 ppm (0.060 g/l).

Any source of free and/or complex fluoride ions may be used, including, e.g., hydrofluoric acid, fluoboric acid, hydrofluosilicic acid, alkali metal and ammonium bifluorides, and mixtures thereof. A mixture of hydrofluoric acid and hydrofluosilicic acid is preferred, wherein hydrofluosilicic acid is present in a concentration from about 3 ppm (0.003 g/l) to about 50 ppm (0.050 g/l), preferably 3 ppm (0.003 g/l) to about 25 ppm (0.025 g/l). An amount of fluoride which is sufficient to form a complex with the zirconium is generally necessary to maintain the stability of the treatment composition. In order to maintain the composition activity and avoid precipitation in the treatment composition during a continuous coating process, excess fluoride must generally be made available to complex the aluminum that has dissolved in the treatment composition from the metal surface. For this purpose, about three moles of fluoride for each mole of aluminum are preferably present. Therefore, the concentration of fluoride ions in the treatment composition preferably ranges from about 20 ppm (0.020 g/l) to about 200 ppm (0.200 g/l), most preferably from about 30 ppm (0.030 g/l) to about 100 ppm (0.100 g/l).

The concentration of free fluoride in the treatment bath may be conveniently measured in millivolts (mv) by a fluoride ion electrode. The measurement, however, will depend upon the specific composition of the treatment bath and the corresponding pH. Accordingly, the correlation between the millivolt reading and the free fluoride content should be completed on a treatment bath which has an essentially constant pH. By using such a correlation, the millivolt reading may serve as a simple commercial control of the treatment bath. For example, a satisfactory treatment bath at a pH of about 2.7 is achieved by providing a free fluoride concentration to produce a millivolt reading of about −60 mv, calibrated against a standard solution measured at 0 mv, containing 20 ppm (0.020 g/l) fluoride ions added as NaF adjusted to pH 1.3. The appropriate millivolt reading of the fluoride ion concentration can be readily ascertained in any treatment bath.

The presence of free phosphate or phosphoric acid in the treatment bath is important to form the desirable coating on the treated surface at a lower temperature and to maintain a hydrophilic, water-break-free surface condition. Such a condition will allow the uniform application of the desired coating on the surface. A uniform coating and water-break-free surface condition is attained by preferably maintaining a phosphate concentration of at least about 2–3 ppm (0.002–0.003 g/l), more typically at least about 5 ppm (0.005 g/l) in the treatment bath. More particularly, the phosphate ion concentration in the treatment bath preferably ranges from about 10 ppm (0.010 g/l) to about 75 ppm (0.750 g/l), with about 15 ppm (0.015 g/l) to about 50 ppm (0.050 g/l) being most preferred. Any source of free phosphate or phosphoric acid may be used, although phosphoric acid, itself, is preferred.

The treatment bath also includes a suitable anionic organic phosphate acid ester, such as GAFAC RP 710 and GAFAC PE 510 (GAF Corporation, Wayne, N.J.) as well as MAPHOS 60 and MAPHOS 66 (Mazer Chemical, Gurnee, Ill.). GAFAC RP 710 is preferred as the source of the phosphate acid ester. The phosphate acid ester concentration preferably ranges from about 50 ppm (0.050 g/l) to about 1000 ppm (1.00 g/l), most preferably from about 100 ppm (0.100 g/l) to about 500 ppm (0.500 g/l).

Further, the treatment bath includes a suitable water-soluble, polyethylene glycol (PEG) ester of a fatty acid, such as lauric acid and stearic acid, and preferably having a molecular weight ranging from about 200 to about 4000. The PEG ester of lauric acid is preferred. Examples of such preferred PEG esters include MAPEG 400 ML (PEG (400) monolaurate) and MAPEG 200 ML (PEG (200) monolaurate) (both available from Mazer Chemical, Gurnee, Ill.) as well as PEGOSPERSE 400 ML (POE 9 monolaurate) and PEGOSPERSE 600 ML (PEG (600) monolaurate) (both available from Lonza, Inc.). The concentration of the PEG ester of a fatty acid preferably ranges from about 10 ppm (0.010 g/l) to about 500 ppm (0.500 g/l); about 50 ppm (0.050 g/l) to about 150 ppm (0.150 g/l) is most preferred.

The pH of the treatment bath can be adjusted by any suitable means, e.g., by addition of an appropriate acid or base. However, the pH of the treatment bath is preferably adjusted by the addition of nitric acid. The nitric acid concentration in the treatment bath will typically range from about 100 ppm ( 0.100 g/1 ) to about 500 ppm (0.500 g/l) to attain an acceptable pH in the range of about 2.0 to about 5.0, preferably about 2.5 to about 4.0.

The treatment bath may additionally contain a water conditioner, e.g., EDTA salts or DTPA salts, such as HAMPEX 80 (W.R. Grace Company, Lexington, Mass.), and ammonium hydroxide. The concentration of water conditioner is preferably about i ppm (0.001 g/l) to about 25 ppm (0.025 g/l). The concentration of ammonium hydroxide preferably ranges from about 10 (0.010 g/l) ppm to about 60 ppm (0.060 g/l). The amount of ammonium hydroxide added to the composition will be determined, in part, by the desired pH of the treatment bath.

EXAMPLES

Various treatment compositions were prepared to demonstrate the efficacy of the present invention. Aluminum cans were subjected to treatment baths in accordance with the present invention, as well as comparative treatment baths, and the aluminum cans were then evaluated using the muffle furnace test, the tape adhesion test, and the mobility friction test, as described below.

Muffle Furnace Test

The muffle furnace test was performed to determine whether a cleaned and treated can had been successfully coated and to qualitatively determine the degree of coating. The muffle furnace test was performed by placing a cleaned and treated can inside a muffle furnace at about 480° C. to about 540° C. for about 4 to 5 minutes. The presence of a coating was determined by discerning a light yellow to golden discoloration of the treated surface, depending on the amount of coating. An aluminum can without a coating has a grayish appearance.

Tape Adhesion Test

The tape adhesion test was performed to measure the adhesion between a treated surface and an organic finish or overcoating. Miller white ink from Acme was applied, using a rubber brayer. Water-borne, wet-ink varnish, designated as 3625X from PPG Company, was roll-coated with a #10 draw-down bar to achieve a coating thickness of 2.5 mg/in$^2$. The coated surface was cured in a forced-air oven for 90 seconds at about 177° C. The finished (i.e., painted) surface, after being cured, was immersed in boiling tap water or a 1% detergent (such as "Joy," a commercially available Proctor & Gamble product) solution for 15 minutes, rinsed in tap water, and dried. The treated surface was then cross-hatched, and Scotch brand transparent tape (#610) (commercially available from 3M) was applied to the cross-hatched area. The amount of paint removed by the tape was observed, and the results were rated as follows:

| | |
|---|---|
| 10 | Excellent adhesion |
| 8–9 | Very slight removal |
| 0 | Complete removal of coating |

Mobility Friction Test

The mobility friction test was performed to determine the mobility characteristics of cleaned and treated cans. Aluminum cans were initially cleaned using a commercially available acid cleaner, e.g., Coral CLENE 101 (Coral International, Waukegan, Ill.). After rinsing, the cans were subjected to a treatment bath, rinsed in deionized water, and dried in an oven at about 190° C. for about 3 minutes. A laboratory friction tester was then used to perform the actual mobility friction test on the treated cans.

Specifically, two cans were placed on a tray, with the bottoms of the cans facing the end of the friction tester machine. A third can was laid upon the two cans with its bottom in opposite direction to the bottoms of the two lower cans. Upon operation, the tester automatically raised the tray, while simultaneously activating a timer. When the tray reached a certain angle at which the top could slide past an electric eye, the timer stopped and the elapsed time was recorded. The period of time measured by the timer was defined as the "slip time." The lower the "slip time," the better the mobility characteristics. Typical results were as follows:

| | Slip Time |
|---|---|
| Cans Without Mobility Treatment | 36 seconds |
| Cans With Mobility Treatment | 15–25 seconds |

The following examples are provided to illustrate the invention. These examples, however, should not be construed as limiting the overall scope of the invention.

EXAMPLE 1

Typical treatment solutions (Compositions A-F) of the present invention were prepared by adding the following ingredients to water in the indicated concentrations:

TABLE I

| | COMPOSITIONS (g/l) | | | | | |
|---|---|---|---|---|---|---|
| | A | B | C | D | E | F |
| Components | | | | | | |
| Hydrofluozirconic acid | 0.056 | 0.056 | 0.056 | 0.056 | 0.056 | 0.056 |
| Hydrofluosilicic acid | 0.006 | 0.006 | 0.006 | 0.006 | 0.006 | 0.006 |
| Hydrofluoric acid | 0.052 | 0.052 | 0.052 | 0.052 | 0.052 | 0.052 |
| Phosphoric acid | 0.020 | 0.020 | 0.020 | 0.020 | 0.020 | 0.020 |
| Nitric acid | 0.175 | 0.175 | 0.175 | 0.175 | 0.175 | 0.175 |
| Hampex 80[1] | 0.003 | 0.003 | 0.003 | 0.003 | 0.003 | 0.003 |
| Ammonium hydroxide | 0.030 | 0.030 | 0.030 | 0.030 | 0.030 | 0.030 |
| Phosphate acid ester[2] | 0.185 | 0.072 | 0.143 | 0.214 | 0.286 | 0.357 |
| Polyethylene glycol ester of fatty acid[3] | 0.063 | 0.028 | 0.057 | 0.086 | 0.114 | 0.143 |
| Characteristics | | | | | | |
| Zirconium ions | 0.025 | 0.025 | 0.025 | 0.025 | 0.025 | 0.025 |
| Fluoride ions | 0.084 | 0.084 | 0.084 | 0.084 | 0.084 | 0.084 |
| Phosphate ions | 0.019 | 0.019 | 0.019 | 0.019 | 0.019 | 0.019 |
| pH | 2.5 | 2.5 | 2.5 | 2.5 | 2.5 | 2.5 |
| Organic package ratio[4] | 2.9 | 2.5 | 2.5 | 2.5 | 2.5 | 2.5 |
| Organic package amount[5] | 0.248 | 0.100 | 0.200 | 0.300 | 0.400 | 0.500 |
| Organic package to zirconium ion ratio | 10.0 | 4.0 | 8.0 | 12.1 | 16.1 | 20.2 |
| Organic package to phosphoric acid ratio | 12.5 | 5.0 | 10.0 | 15.0 | 20.0 | 25.0 |

[1]Hampex 80 (commercially available from W. R. Grace Company, Lexington, Massachusetts) is a water conditioner that is a 40% solution of pentasodium diethylenetriamine pentaacetate.
[2]GAFAC RP 710 (commercially available from GAF Corporation, Wayne, New Jersey) is designated as free acid of complex organic phosphate ester.
[3]MAPEG 400 ML (commercially available from Mazer Chemical, Gurnee, Illinois) is designated as a polyethylene glycol ester of lauric acid.
[4]The organic package ratio is the ratio of phosphate acid ester to polyethylene glycol ester of fatty acid.
[5]The organic package amount is the total amount of phosphate acid ester and polyethylene glycol ester of fatty acid.

The phosphate acid ester and polyethylene glycol ester of fatty acid together are referred to as the "organic package" in these Examples. It should be appreciated that upper limits of phosphate acid ester, polyethylene glycol ester of fatty acid, and water conditioner, for example, may be established by appropriate cost-effectiveness studies.

EXAMPLE 2

Comparative treatment compositions (Compositions G-L) were prepared by adding the following ingredients to water in the indicated concentrations:

TABLE II

| | COMPOSITIONS (g/l) | | | | | |
|---|---|---|---|---|---|---|
| | G | H | I | J | K | L |
| Components | | | | | | |
| Hydrofluozirconic acid | 0.056 | 0 | 0 | 0 | 0 | 0.056 |
| Hydrofluosilicic acid | 0.006 | 0 | 0 | 0 | 0 | 0.006 |
| Hydrofluoric acid | 0.052 | 0 | 0 | 0.150 | 0 | 0.052 |
| Phosphoric acid | 0.020 | 0 | 0 | 0 | 0.180 | 0 |
| Nitric acid | 0.175 | 0 | 0.125 | 0 | 0 | 0.175 |
| Hampex 80[1] | 0.003 | 0 | 0 | 0 | 0 | 0.003 |
| Ammonium hydroxide | 0.030 | 0 | 0 | 0 | 0 | 0.030 |
| Phosphate acid ester[2] | 0 | 0.500 | 0.500 | 0.500 | 0.500 | 0.185 |
| Polyethylene glycol ester of fatty acid[3] | 0 | 0.200 | 0.200 | 0.200 | 0.200 | 0.030 |
| Characteristics | | | | | | |
| Zirconium ions | 0.025 | 0 | 0 | 0 | 0 | 0.025 |
| Fluoride ions | 0.084 | 0 | 0 | 0.142 | 0 | 0.084 |
| Phosphate ions | 0.019 | 0 | 0 | 0 | 0.175 | 0 |
| pH | 2.5 | 6.0 | 3.0 | 3.0 | 3.0 | 2.5 |
| Organic package ratio[4] | 0 | 2.5 | 2.5 | 2.5 | 2.5 | 6.2 |
| Organic package amount[5] | 0 | 0.700 | 0.700 | 0.700 | 0.700 | 0.215 |
| Organic package to zirconium ion ratio | 0 | 0 | 0 | 0 | 0 | 8.6 |
| Organic package to phosphoric acid ratio | 0 | 0 | 0 | 0 | 3.9 | 0 |

[1]Hampex 80 (commercially available from W. R. Grace Company, Lexington, Massachusetts) is a water conditioner that is a 40% solution of pentasodium diethylenetriamine pentaacetate.
[2]GAFAC RP 710 (commercially available from GAF Corporation, Wayne, New Jersey) is designated as free acid of complex organic phosphate ester.
[3]MAPEG 400 ML (commercially available from Mazer Chemical, Gurnee, Illinois) is designated as a polyethylene glycol ester of lauric acid.
[4]The organic package ratio is the ratio of phosphate acid ester to polyethylene glycol ester of fatty acid.
[5]The organic package amount is the total amount of phosphate acid ester and polyethylene glycol ester of fatty acid.

EXAMPLE 3

The following experiment was performed to determine the effect of the organic components on conversion coating of aluminum cans, resulting mobility characteristics, and adhesion properties.

Drawn and ironed aluminum cans were cleaned with an acid cleaner, such as CLENE 101, using a spray washer. After cleaning, the cans were rinsed with cold tap water to provide a water-break-free surface. The rinsed cans then were subjected to the treatment baths of Compositions B-F of Example I which possessed varied levels of the organic package (phosphate acid ester to polyethylene glycol ester of fatty acid ratio of 2.5 to 1), at about 43° C. for 15 seconds. For comparison purposes, some cans were only cleaned but not subjected to any other treatment, while other cans were cleaned and treated with the composition identified as Concentration A, Example 1, in U.S. Pat. No. 4,470,853. Afterwards, all the cans were rinsed in tap water, then rinsed in deionized water, and oven dried at about 177° C. for 3.5 minutes. The cans were then subjected to the muffle furnace, mobility friction, and coating adhesion tests, with the following results:

TABLE III

| Substrate | Muffle Furnace Test (Color of Can) | Tape Adhesion Test (Rating) | Mobility Friction Test (Slip Time) |
|---|---|---|---|
| Cleaned-only cans | grayish | 10 | 36 seconds |
| Composition B (containing 100 ppm organic package) | light gold | 10 | 35 seconds |
| Composition C (containing 200 ppm organic package) | light gold | 10 | 30 seconds |
| Composition D (containing 300 ppm organic package) | light gold | 10 | 24 seconds |
| Composition E (containing 400 ppm organic package) | light gold | 10 | 20 seconds |
| Composition F (containing 500 ppm organic package) | light gold | 10 | 17 seconds |
| Composition G (no organic package) | gold | 10 | 36 seconds |
| Cleaned and treated using Concentrate A, Example 1, of U.S. Pat. No. 4,470,853 | gold | 10 | 36 seconds |

The results indicated that the present invention provides a conversion coating on aluminum cans which enhances the mobility characteristics of the treated surfaces, without adversely affecting the adhesion characteristics of the treated surfaces.

EXAMPLE 4

Surface analysis of several different substrates was conducted by ESCA to determine the distribution and concentration of certain components on the treated aluminum surface. The results tend to indicate that a specific ratio of organic carbon to zirconium preferably should be maintained on the treated surface to achieve the desired mobility characteristics. The following samples were prepared and subjected to ESCA surface analysis:

Sample 1: Cleaned and treated using Composition G (Table II) with no organic package (FIG. 1).

Sample 2: Cleaned and treated using Composition C (Table I) with 200 ppm of organic package (FIG. 2).

Sample 3: Cleaned and treated using Composition D (Table I) with 300 ppm of organic package (FIG. 3).

Sample 4: Cleaned-only sample (FIG. 4 ).

Figure 2:
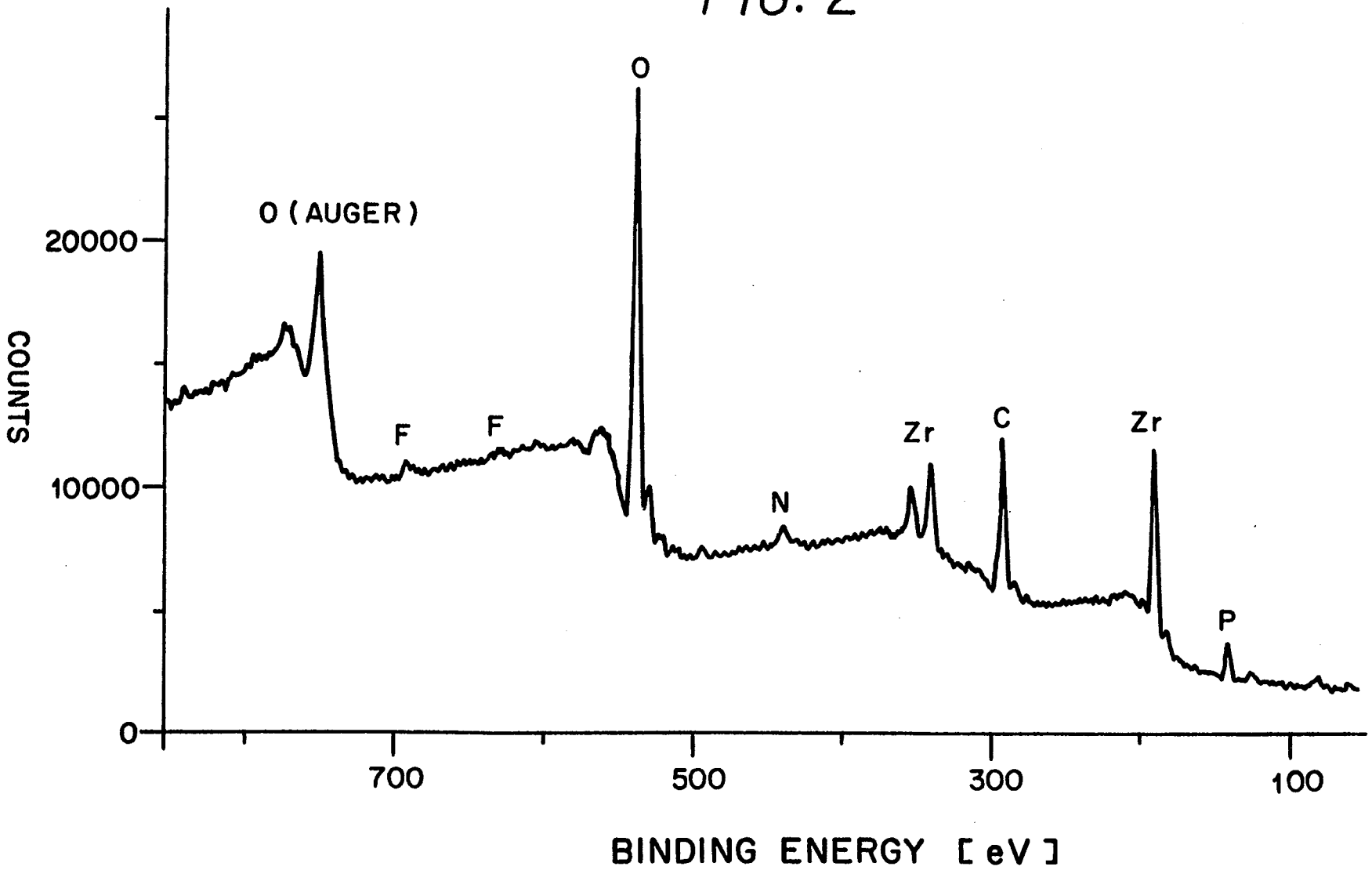
FIG. 2 depicts ESCA results of the surface analysis of a cleaned aluminum surface treated with a preferred composition of the present invention containing 200 ppm of a 2.5:1 composition of a phosphate acid ester and a polyethylene glycol ester of fatty acid.
Figure 3:
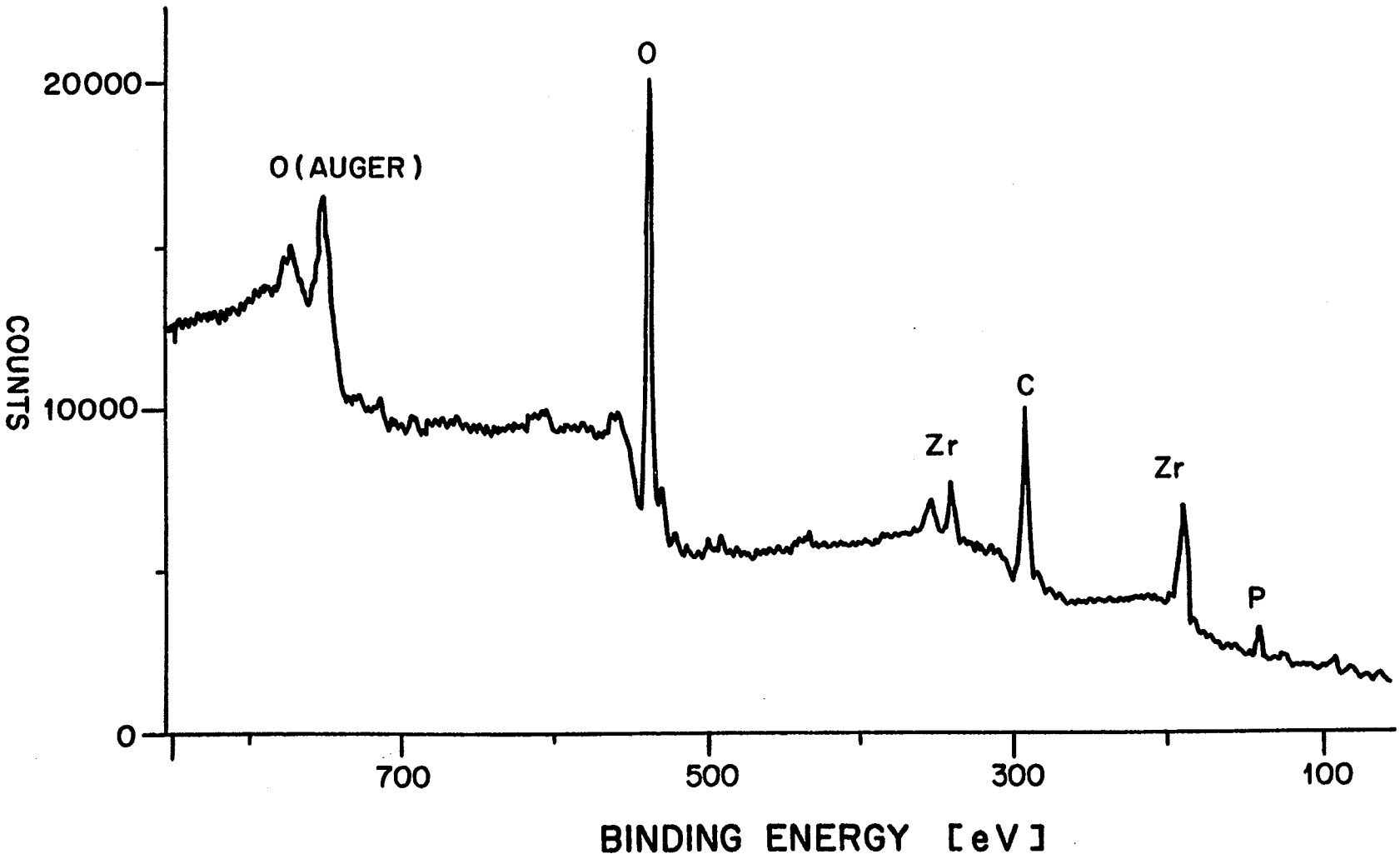
FIG. 3 depicts ESCA results of the surface analysis of a cleaned aluminum surface treated with a preferred composition of the present invention containing 300 ppm of a 2.5:1 composition of a phosphate acid ester and polyethylene glycol ester of fatty acid.
Figure 4:
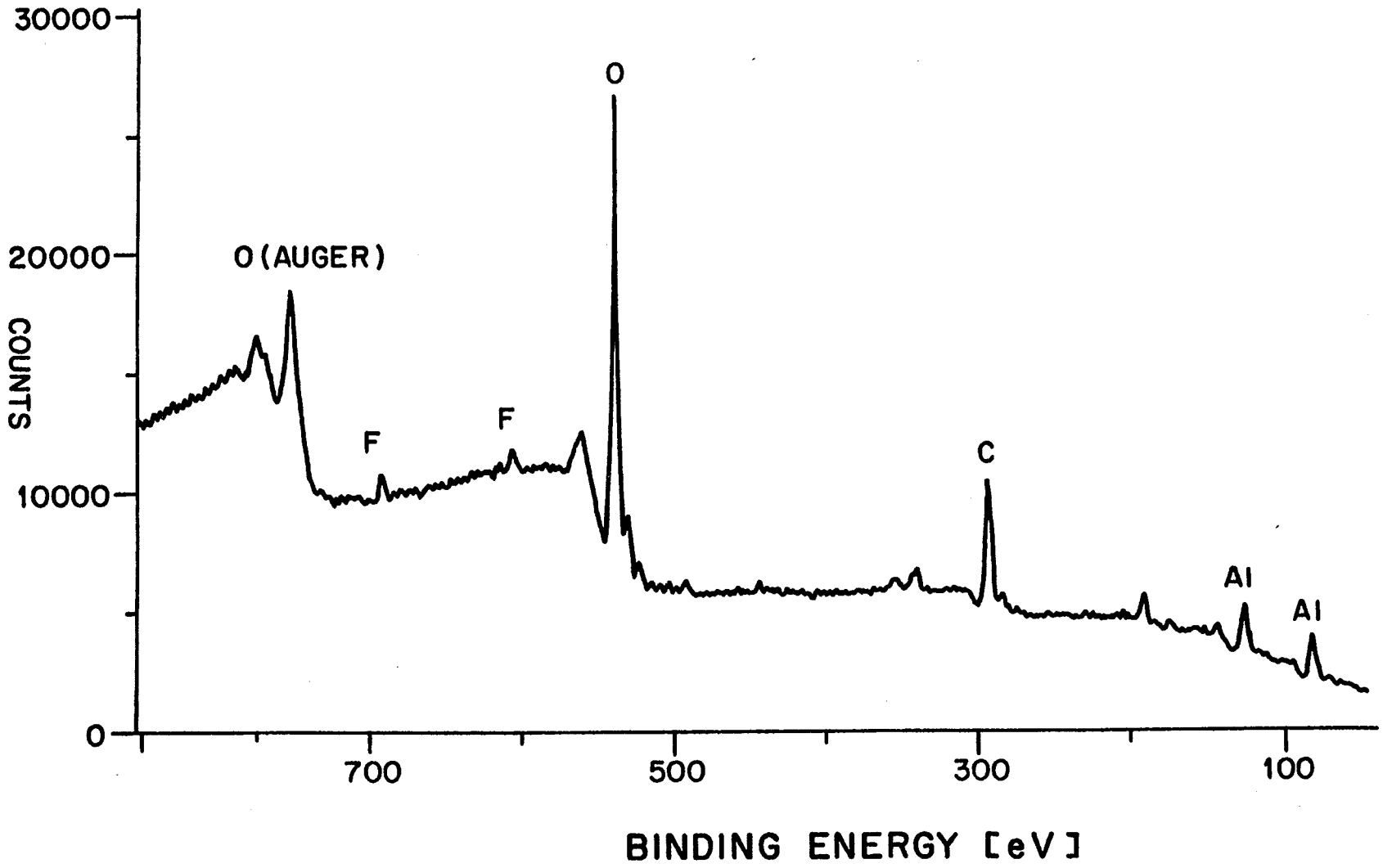
FIG. 4 depicts ESCA results of the surface analysis of a cleaned, untreated aluminum surface.

The ESCA surface analyses of Samples 1–4 are shown in FIGS. 1–4, respectively. FIGS. 1–3 indicate the presence of zirconlure (Zr), phosphate (P) , carbon (C) , and oxide (O) in the resulting conversion coating. The surface analysis of the cleaned, untreated can is shown in FIG. 4. The intensity counts of zirconium, oxygen, and carbon (organics) were determined from each spectrum. The results are tabulated as follows:

TABLE IV

| | Intensity: Counts/Sec. | | | Ratio | Ratio |
|---|---|---|---|---|---|
| | Zirconium (Zr) | Oxide (O) | Carbon (Organic) (C) | Org. Carbon/ Zirconium | Org. Carbon/ Oxide |
| Sample 1 | 7047 | 12871 | 2490 | 0.35 | 0.19 |
| Sample 2 | 6835 | 17523 | 6198 | 0.91 | 0.35 |
| Sample 3 | 3315 | 13631 | 5600 | 1.69 | 0.41 |
| Sample 4 | — | 15322 | 4527 | — | 0.29 |

The presence of zirconium and phosphate in Sample I indicates the existence of the conversion coating on the surface of the treated samples. The C/Zr ratio was 0.35, and the C/O ratio was 0.19. The surface treated with a composition lacking organic package, however, did not exhibit enhanced mobility characteristics (Composition G, Table III). Sample 4, the cleaned-only surface, did not have the conversion coating and exhibited poor mobility (Cleaned-only Cans, Table III). In contrast, Samples 2 (Composition C, Table III) and 3 (Composition D, Table III), which had been treated with compositions containing different concentrations of the organic package, had zirconium and phosphate on the surface, indicative of a conversion coating, and demonstrated improved mobility characteristics.

The results in Table IV show that there is a substantial increase in the carbon/zirconium ratio in Samples 2 and 3. Therefore, it can be concluded that organic components, such as those in Compositions C and D (of Example 1), are chemically deposited in conjunction with zirconium and phosphate during the conversion coating process, resulting in the attainment of the desired mobility characteristics of the treated aluminum can surfaces.

EXAMPLE 5

To evaluate the effect of the zirconium component of the treatment bath of the present invention, treatment baths which lacked zirconium ions were prepared with Compositions H-K as set forth in Table II of Example 2.

Cleaned aluminum cans were subjected to treatment baths H-K at about 43° C. The cans were then rinsed and dried in an oven at about 191° C. for 3 minutes. The treated cans did not exhibit surface-coatings and did not demonstrate the desired mobility characteristics. Furthermore, the can surfaces demonstrated undesirable water-breaking characteristics. These results indicated that a zirconium-free coating would not provide the desired conversion coating with improved mobility characteristics on aluminum can surfaces.

EXAMPLE 6

In order to determine if phosphoric acid addition to the treatment bath was necessary to achieve an enhanced mobility of aluminum can surfaces, a treatment bath which lacked phosphoric acid was prepared with Composition L as set forth in Table II of Example 2.

Aluminum cans which had been drawn and ironed and subsequently cleaned, using CLENE 101, were subjected to the treatment bath at about 43° C. After rinsing, the cans exhibited undesirable water-breaking characteristics. After inspection and testing, it was determined that the resulting cans had no surface coatings and exhibited no mobility enhancement. The addition of about 10 ppm to about 30 ppm of phosphoric acid to the above treatment bath, however, produced a completely water-break-free can surface that formed desirable surface coatings and demonstrated excellent mobility enhancement.

EXAMPLE 7

The present invention was tested at a commercial aluminum can plant. The experimental treatment bath comprised the following ingredients:

| | grams/liter |
|---|---|
| Hydrofluozirconic acid | 0.054 |
| Hydrofluosilicic acid | 0.006 |
| Hydrofluoric acid | 0.052 |
| Phosphoric acid | 0.003 |
| Nitric acid | 0.175 |
| Hampex 80 | 0.003 |
| Ammonium hydroxide | 0.056 |
| GAFAC RP 710 | 0.225 |
| MAPEG 400 ML | 0.075 |
| Tannic acid | 0.003 |

Process conditions of the experimental treatment bath were as follows:

| | |
|---|---|
| pH | 3.02 |
| Fluoride (relative millivolt) | −35 mv |
| Dissolved aluminum | 56 ppm |
| Temperature | 41° C. |

During the experiment, the can washer process sequence was as follows:

1. Pre-clean, using Coral CLENE 101 acid cleaner.
2. Clean, using Coral CLENE 101 acid cleaner.
3. Tap water rinse.
4. Treatment with the present invention.
5. Tap water rinse.
6. Deionized water rinse.
7. Dry-off in hot-air oven.

Figure 5:
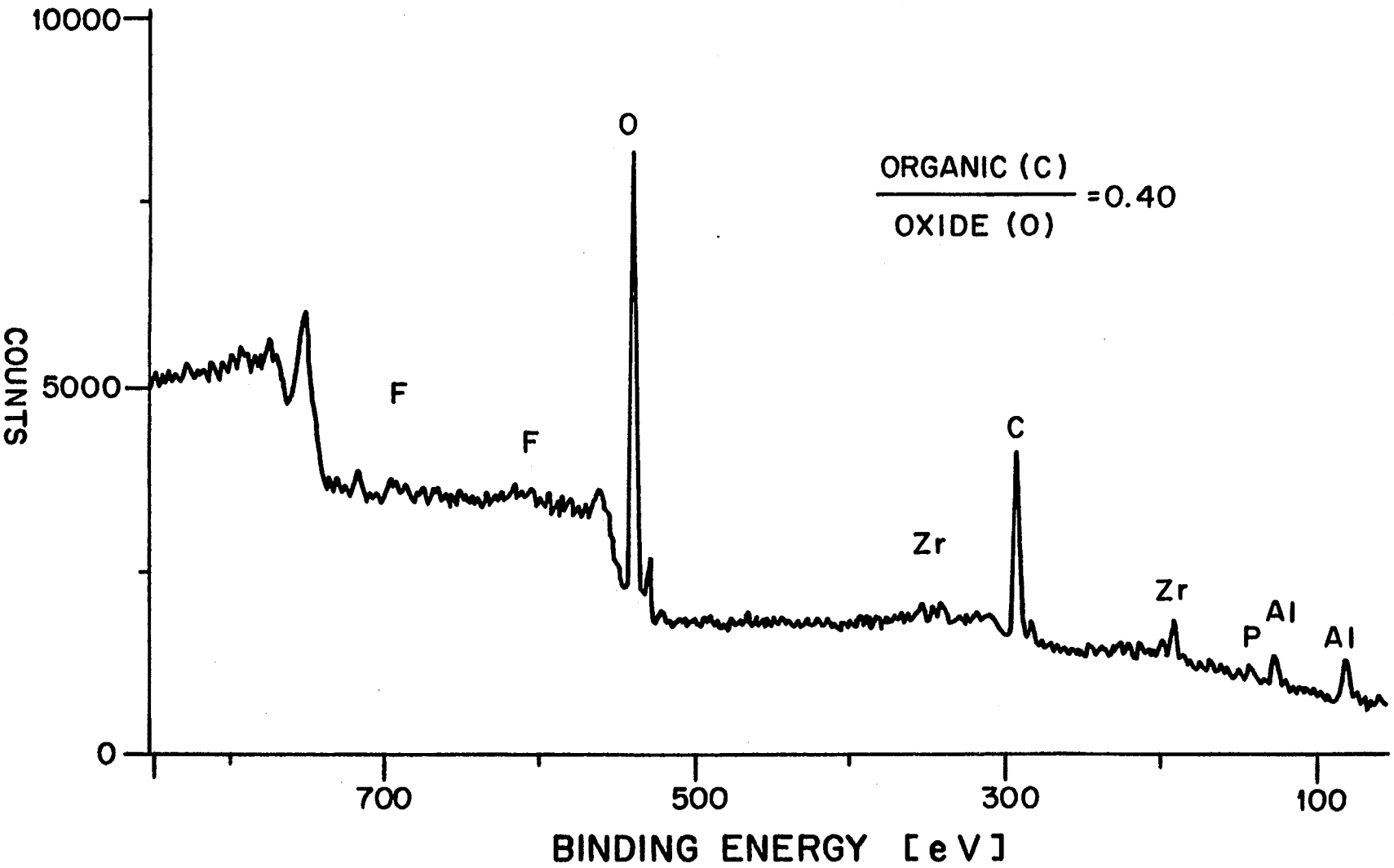
FIGS. 5 and 6 depict ESCA results of the surface analyses of drawn and ironed aluminum cans that have been cleaned with a commercially available acid cleaner, rinsed in tap water, sprayed with a preferred composition of the present invention, rinsed in tap water, rinsed in deionized water, and then dried in an oven.
Figure 6:
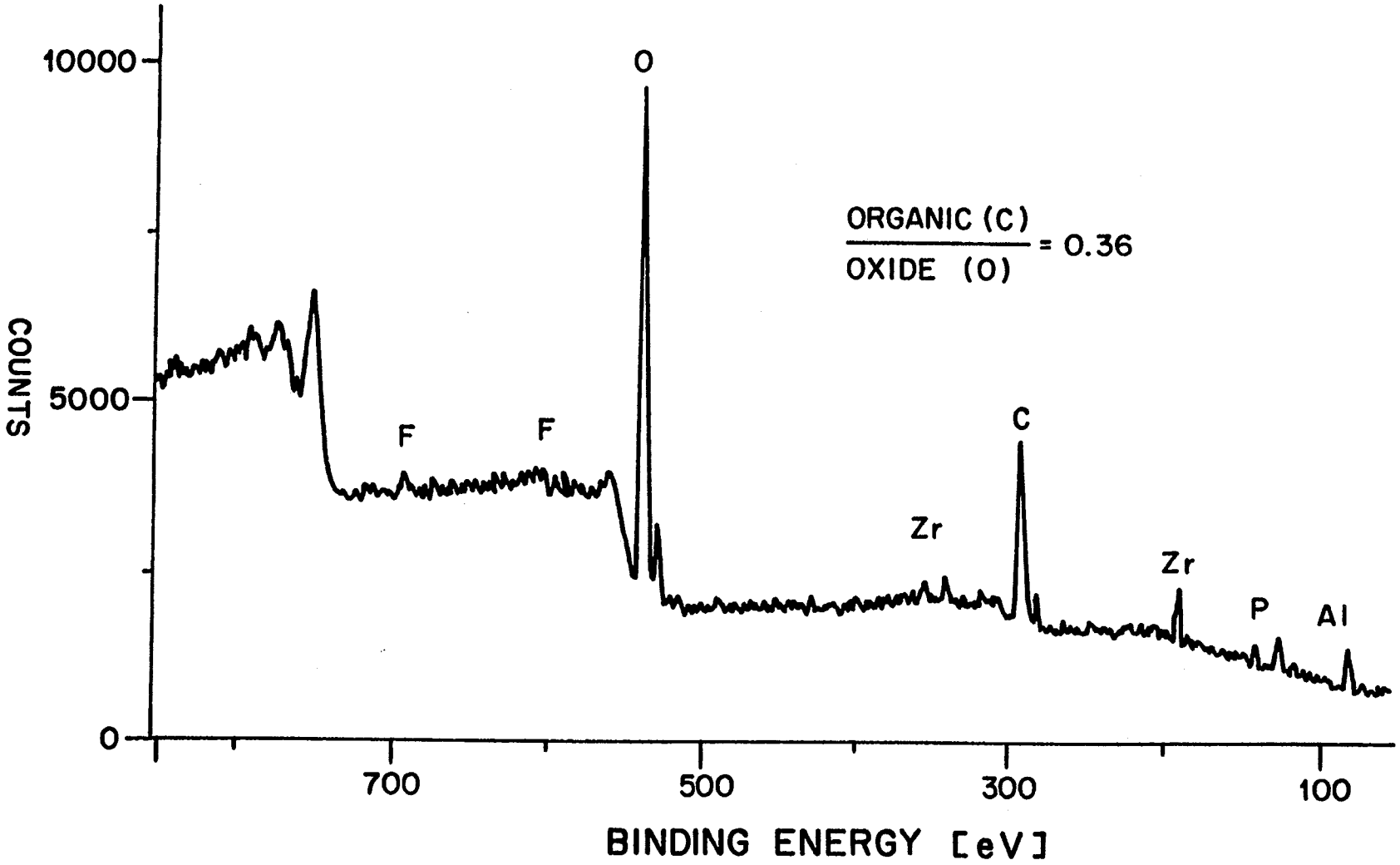

The cans exiting the washer exhibited excellent surface brightness and mobility characteristics. In order to determine the surface properties of the test cans, surfaces were analyzed using the ESCA technique. The results of the analyses are shown in FIGS. 5 and 6, which again depict the presence of zirconium, phosphate, organic carbon, and oxide. The ratio of organic carbon to oxygen (C/O) was found to be between 0.36 and 0.40, which is believed to be indicative of excellent surface mobility.

While this invention has been described with an emphasis upon a preferred embodiment, it will be obvious to those of ordinary skill in the art that variations in the preferred composition and method may be used and that it is intended that the invention may be practiced otherwise than as specifically described herein. Accordingly, this invention includes all modifications encompassed within the spirit and scope of the following claims.

What is claimed is:

1. A method for treating an aluminum or an aluminum alloy surface, the method comprising applying an aqueous, acidic composition to the aluminum or aluminum alloy surface, the composition comprising a source of zirconium ions, a source of fluoride ions, a source of phosphate ions, a phosphate acid ester, a polyethylene glycol ester of a fatty acid, and nitric acid wherein the concentration of zirconium ions is from about 10 ppm to about 100 ppm, the concentration of fluoride ions is from about 20 ppm to about 200 ppm, and the concentration of the phosphate ions is from about 5 to about 75 ppm.

2. The method according to claim 1, wherein the pH of the composition is from about 2.0 to about 5.0.

3. The method according to claim 2, wherein the pH of the composition is from about 2.5 to about 4.0.

4. The method according to claims 1 or 2, wherein the composition is applied to said aluminum or aluminum alloy surfaces at a temperature between about 30° C. to about 55° C.

5. The method according to claim 4, wherein the composition is applied to said aluminum or aluminum alloy surface at a temperature between about 35° C. to about 50° C.

6. The method according to claim 2, wherein the composition is applied to said aluminum or aluminum alloy surface for about 10 seconds to about 60 seconds.

7. The method according to claim 6, wherein the composition is applied to said aluminum or aluminum alloy surface during the treatment cycle of washing formed materials.

8. The method according to claim 7, wherein the free fluoride ion concentration is maintained at about 30 ppm to about 100 ppm.

9. The method according to claim 1, wherein an aluminum or aluminum alloy surface carbon to oxygen ratio between about 0.36 and about 0.40 is obtained.

10. A method for treating an aluminum or aluminum alloy surface, the method comprising applying an aqueous, acidic composition comprising about 56 ppm hydrofluozirconic acid, about 6 ppm hydrofluosilicic acid, about 52 ppm hydrofluoric acid, about 175 pm nitric acid, about 185 ppm phosphate acid ester, and 63 ppm polyethylene glycol ester of fatty acid, about 20 ppm phosphoric acid, about 3 ppm water conditioner, and about 30 ppm ammonium hydroxide, pH from about 2.5 to about 4.0, and which, upon application for about 10 seconds to about 60 seconds results in an aluminum or aluminum alloy surface carbon to oxygen ratio between 0.35 and about 0.41.

11. The method for treating aluminum or aluminum alloy surface, according to claim 10, wherein the temperature during treatment is from about 30° C. to about 55° C.

12. The method for treating aluminum or aluminum alloy surface, according to claim 11, wherein the temperature during treatment is from about 35° C. to about 50° C.

13. The method for treating aluminum or aluminum alloy surface, according to claim 10, wherein the fluoride ion concentration during treatment is maintained at about 20 ppm to about 200 ppm.

14. The method for treating aluminum or aluminum alloy surface, according to claim 13, wherein the fluoride ion concentration during treatment is maintained at about 30 ppm to about 100 ppm.

15. The method according to claim 4, wherein the composition is applied to said aluminum or aluminum alloy surface for about 10 to about 60 seconds.

16. The method according to claim 2, wherein the source of fluoride ions is selected from the group consisting of hydrofluoric acid, fluoboric acid, hydrofluosilicic acid, alkali metal bifluorides, ammonium bifluorides, and mixtures thereof.

17. The method according to claim 6, wherein the source of fluoride ions is a mixture of hydrofluoric acid and hydrofluosilicic acid.

18. The method according to claim 2, wherein the concentration of hydrofluosilicic acid is from about 3 ppm to about 50 ppm.

19. The method according to claim 2, wherein the source of phosphate ions is phosphoric acid.

20. The method according to claim 18, wherein the concentration of phosphate ions is from about 15 ppm to about 50 ppm.

21. The method according to claim 2, wherein the polyethylene glycol ester of a fatty acid is selected from the group consisting of polyethylene glycol ester of lauric acid, polyethylene glycol ester of stearic acid and mixtures thereof.

22. A method of enhancing the mobility of a surface of an aluminum can or an aluminum alloy can, the method comprising applying an aqueous, acidic composition to the aluminum can or aluminum alloy surface of the can, the composition comprising a source of zirconium ions, a source of fluoride ions, a source of phosphate ions, a phosphate acid ester, a polyethylene glycol ester of a fatty acid, and nitric acid to said aluminum and aluminum alloy surfaces, wherein the concentration of zirconium ions is from about 10 ppm to about 100 ppm, the concentration of fluoride ions is from about 20 ppm to about 200 ppm, and the concentration of the phosphate ions is from about 5 to about 75 ppm.

23. The method according to claim 22, wherein the pH of the compositions is from about 2.0 to about 5.0.

24. The method according to claim 23, wherein the pH of the composition is from about 2.5 to about 4.0.

25. The method according to claim 23, wherein the composition is applied to said aluminum or aluminum alloy surfaces at a temperature between about 30° C. to about 55° C.

26. The method according to claim 25, wherein the composition is applied to said aluminum or alloy surface at a temperature between about 35° C. to about 50° C.

27. The method according to claim 23, wherein the composition is applied to said aluminum or aluminum alloy surfaces for about 10 seconds to about 60 seconds.

* * * * *